US010820381B2

(12) United States Patent
Frank et al.

(10) Patent No.: US 10,820,381 B2
(45) Date of Patent: Oct. 27, 2020

(54) METHOD FOR OPERATING AN INDUCTION HOB, AND INDUCTION HOB

(71) Applicant: E.G.O. Elektro-Geraetebau GmbH, Oberderdingen (DE)

(72) Inventors: Marcus Frank, Sulzfeld (DE); Christian Egenter, Bretten (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 435 days.

(21) Appl. No.: 15/727,122

(22) Filed: Oct. 6, 2017

(65) Prior Publication Data

US 2018/0103511 A1 Apr. 12, 2018

(30) Foreign Application Priority Data

Oct. 10, 2016 (DE) ..... 10 2016 219 590

(51) Int. Cl.
*H05B 6/12* (2006.01)
*H05B 6/06* (2006.01)

(52) U.S. Cl.
CPC ..... *H05B 6/062* (2013.01); *H05B 6/1209* (2013.01); *H05B 2213/07* (2013.01)

(58) Field of Classification Search
CPC ..... H05B 6/062; H05B 6/065; H05B 6/1209; H05B 6/1272; H05B 2213/03; H05B 2213/04; H05B 2213/05; H05B 2213/07
(Continued)

(56) References Cited

U.S. PATENT DOCUMENTS 6,888,110 B2 5/2005 Baier et al.
9,451,657 B2 9/2016 Schilling et al.
(Continued)

FOREIGN PATENT DOCUMENTS

DE 10329840 A1 1/2005
DE 102009047185 A1 6/2011
(Continued)

OTHER PUBLICATIONS

European Patent Office, Extended European Search Report for Application No. 17192545.6, dated Feb. 23, 2018, 10 pages, Germany.

*Primary Examiner* — Hung D Nguyen
(74) *Attorney, Agent, or Firm* — Alston & Bird LLP

(57) ABSTRACT

In order to heat water in a cooking vessel which is placed above at least one induction heating coil of an induction hob, a controller drives the induction heating coil with a pre-specified relatively high power density. During the heating, operating parameters of the induction heating coil are detected and evaluated by the controller in order to monitor a relative temperature profile of the temperature of a cooking vessel base. As soon as this relative temperature profile levels off to a considerable extent or a gradient of the relative temperature profile decreases, the controller identifies this and determines this as the situation of a "lightly boiling" state and of a temperature of a top side of the cooking vessel base which is 5° C. to 15° C. below the boiling point being reached. The power density is then automatically reduced for a predetermined hold time, wherein an operator can maintain this state or, after a certain time, heating up can be performed to a greater extent again automatically.

18 Claims, 1 Drawing Sheet

(58) Field of Classification Search
USPC ..... 219/620, 625, 627, 628, 635, 660, 667
See application file for complete search history.

(56) References Cited

U.S. PATENT DOCUMENTS

| | | | | |
|---|---|---|---|---|
| 9,491,807 | B2 | 11/2016 | Schilling et al. | |
| 9,554,424 | B2 | 1/2017 | Schilling et al. | |
| 2010/0181302 | A1* | 7/2010 | Ernst | H05B 6/062 219/660 |
| 2011/0089156 | A1 | 4/2011 | Santacatterina et al. | |
| 2011/0120989 | A1 | 5/2011 | Schilling et al. | |
| 2013/0037535 | A1* | 2/2013 | Ogasawara | H05B 6/062 219/622 |
| 2013/0078346 | A1 | 3/2013 | Schilling et al. | |

FOREIGN PATENT DOCUMENTS

| | | | | |
|---|---|---|---|---|
| DE | 102011083383 | A1 | 3/2013 | |
| DE | 102011083397 | A1 | 3/2013 | |
| EP | 1492385 | A2 | 12/2004 | |
| EP | 2574143 | A2 * | 3/2013 | H05B 6/062 |
| EP | 2574143 | A2 | 3/2013 | |
| WO | WO 2008/148529 | A1 | 12/2008 | |

* cited by examiner

METHOD FOR OPERATING AN INDUCTION HOB, AND INDUCTION HOB

CROSS-REFERENCE TO RELATED APPLICATIONS

This application claims priority to German Application No. 10 2016 219 590.5, filed Oct. 10, 2016, the contents of which are hereby incorporated herein in its entirety by reference.

TECHNOLOGICAL FIELD

The invention relates to a method for operating an induction hob in order to heat water or a similar liquid in a hob which is placed above at least one induction heating coil of the induction hob. The invention further relates to an induction hob which is designed to carry out this method.

BACKGROUND

US 2011/120989 A1 discloses detecting a profile of the temperature at the heated cooking vessel or the cooking vessel base of the cooking vessel from oscillation parameters or operating parameters of the induction heating coil when heating a cooking vessel by means of an induction heating coil. Although only a relative temperature profile of the temperature of the cooking vessel base can be detected in this way, certain functions can be derived therefrom. These are described, for example, in US 2013/078346 A1 which is based on the same physical principle.

BRIEF SUMMARY

The invention is based on the problem of providing a method of the kind mentioned in the introductory part and also an induction hob which is designed to carry out the method, with which method and induction hob problems in the prior art can be solved and it is possible, in particular, to provide further convenience functions or operator control functions for operating an induction hob.

This problem is solved by a method and also by an induction hob. Advantageous and preferred refinements of the invention are the subject matter of the further claims and will be explained in greater detail in the text which follows. In the process, some of the features will be described only for the method or only for the induction hob. However, irrespective of this, they are intended to be able to apply both to a method and also to a corresponding induction hob automatically and independently of one another. The wording of the claims is incorporated in the description by express reference.

It is provided that the method, in particular in order to be able to heat water or a corresponding liquid in the cooking vessel which is put into place with different levels of boiling, comprises the following steps.

A controller of the induction hob drives the at least one induction heating coil to inductively heat the cooking vessel which has been placed above the induction heating coil. In the process, the cooking vessel is heated with a prespecified power density, that is to say a specific power per unit area. This can be a high power density, for example higher than 4 W/cm$^2$ to 6 W/cm$^2$, possibly even a maximum or boost power density of up to 12 W/cm$^2$. This power density can be prespecified by an operator. As an alternative, the power density can be prespecified, as it were, in an automatic and programmed-related manner by the controller of the induction hob given a specific manner of operation, for example "water boiling" which can be selected on the induction hob.

During the heating of the cooking vessel, operating parameters of the at least one induction heating coil, advantageously of all of the induction heating coils covered by the cooking vessel and operated in order to heat the cooking vessel, are detected by the controller. An oscillation response of the induction heating coil is advantageously used as an operating parameter. This operating parameter or these operating parameters is/are evaluated in order to detect or to monitor a relative temperature profile of the temperature of the cooking vessel base. This is therefore known from the prior art too.

As soon as the detected or monitored relative temperature profile of the cooking vessel base in the form of a curve levels off to a significant extent or the gradient decreases or even falls below zero, the controller identifies this. The controller then determines this as the situation of a "lightly boiling" state of the water or of the liquid in the cooking vessel. Furthermore, it is then determined that a temperature at the top side of the cooking vessel base which is 5° C. to 15° C. below the boiling point of water has been reached. It should be noted here that this boiling point is based on a height above sea level which is usual in Germany, that is to say approximately 20 m to 500 m above sea level. This height range has an only insignificant effect on the boiling point and can therefore be disregarded. In a refinement of the invention, it can be provided that this height above sea level is input into the induction hob, for example when the induction hob is first installed or when the induction hob is first started up. The controller then takes into account the effects thereof on the boiling point. However, the approximate relative temperature profile is always roughly the same, irrespective of the height. Only the absolute temperature at the start of the "lightly boiling" state will naturally vary and be lower the higher above sea level the induction hob is operated. However, this usually has a certain effect, specifically approximately 5° C., starting at a height greater than 1000 m above sea level. An increase in the relative temperature profile of the cooking vessel base can last for a certain time, in particular 10 seconds to 300 seconds or 400 seconds. This naturally depends on the prespecified power density. If the prespecified power density is very high or at a maximum, in particular when using a so-called boost power density for operating the at least one induction heating coil, the duration can also lie in the range of between 60 seconds and 150 seconds.

Once the water has reached a temperature of 100° C., a further temperature increase cannot take place. In this respect, the top side of the base of the cooking vessel, which top side is in direct contact with the water, cannot reach a higher temperature either. The temperature therefore reaches a kind of saturation point or a kind of stop. However, levelling off of an increase in the temperature of the base of the cooking vessel already occurs beforehand, this being utilized.

After the "lightly boiling" state is identified, the power density is automatically reduced for a predetermined hold time. Therefore, the intention is for it to be possible for vigorous boiling or excessive bubbling when boiling the water or the liquid, which vigorous boiling or excessive bubbling may be undesirable under certain circumstances, to be avoided. The power density can advantageously be reduced to a value of between 1 W/cm$^2$ and 3.5 W/cm$^2$. In relative terms, the power can be reduced by 10% to 50% or even by 75%, depending on the prespecified power density used previously.

An operator is then offered a hold option. This hold option involves, by virtue of operating an operator control element, advantageously a single operator control element which can particularly advantageously be a touch-operated switch, the temperature being regulated at that value which prevailed at the time of the start of the hold time by means of automatic setting of the power density. As an alternative, that power density which had been used at the time of the start of the "lightly boiling" state can be set and kept constant. The power density can be that power density to which the power density has been automatically reduced for the predetermined hold time. Therefore, the operator can also maintain or set this "lightly boiling" state for a longer time by operating the operator control element. By virtue of using the option according to the invention, the operator does not need to set this state, in a complicated manner, himself by way of a power density which leads to this "lightly boiling" state for the long run.

The hold time can lie in the region of a few seconds, advantageously at a maximum of 20 seconds, particularly advantageously a maximum of 10 seconds. Once the hold time has elapsed without the operator having selected the hold option or an operating process for the hold option having been carried out or any other operating process for this induction heating coil with which, for example, a completely different power density is manually set, the prespecified power density is set again. This is a power density which with all probability lies above the power density to which the power density had been automatically reduced during the hold time. Therefore, the cooking vessel base and therefore also the water or the liquid therein can be further heated up again. This can be advantageous even when the operator wishes to use the water not only in the "lightly boiling" state but rather as "vigorous boiling" or bubbling boiling. This is advantageous or frequently used for cooking pasta for example.

"Light boiling" of this kind is used more for cooking potatoes or eggs, for example, and has the advantage that troublesome splashing of hot water in the case of bubbling boiling can be avoided. Furthermore, some foodstuffs can be undesirably vigorously mechanically moved or damaged during preparation by the vigorous water movements in the cooking vessel or else by the vigorous movements of the steam bubbles produced. A "lightly boiling" state may also be more desirable for this reason.

Expressed simply, the invention therefore provides an operator with the option of maintaining an, as it were, stably achieved "lightly boiling" state for a certain hold time. The state has been identified according to the invention. If the operator leaves this possibility or this hold option unused, for example because he wishes to bring the water or the liquid to a vigorous boil, the vigorous boiling is performed automatically after the hold time elapses. A further operating process is not necessary.

In an advantageous refinement of the invention, it can be provided that the operator is provided with a signal when the "lightly boiling" state is reached, that is to say when a temperature of almost 100° C. or a temperature of between 85° C. and 100° C. for the water, at which the hold time for the hold option starts, is reached. Signalling can be performed visually and/or acoustically in accordance with different possibilities which are known to a person skilled in the art. Signalling of this kind can particularly advantageously differ from other types of signalling, so that the operator can precisely identify that this hold option according to the invention is now being offered and the hold time has started to run.

In a refinement of the invention, it can be provided that, after the hold time has elapsed without an operating process for this induction heating coil having been performed, this induction heating coil is operated with a higher power density in order to also further heat the cooking vessel or therefore to bring the water contained in the cooking vessel to an even higher temperature. To this end, at least the prespecified power density can preferably be maintained or reset during the initial heating of the cooking vessel. As an alternative, an even higher power density, for example also a maximum power density, can be set. Therefore, the water in the cooking vessel can be heated to a greater extent to a higher temperature for "vigorous boiling". Therefore, the water can actually be brought fully up to 100° C. or to a maximum temperature, so that it can also boil in a bubbling manner.

It can be provided that, after the "vigorous boiling" state of the water in the cooking vessel has been identified, the operator is offered a boil option for a predetermined boil option time which can last a maximum of 20 seconds, possibly even a maximum of only 10 seconds. To this end, an increase in the relative temperature of the cooking vessel base is stopped by reducing the power density. If, during this boil option, an operator control element is correspondingly operated by an operator, the controller sets the power density at the at least one induction heating coil such that this "vigorous boiling" state in the cooking vessel is maintained. Therefore, the previously used power density, with which this "vigorous boiling" state had been reached, is not necessarily maintained. Specifically, even a lower power density can be sufficient to maintain the state, even if the power density is still intended to be a high power density. To this end, it can advantageously be provided that the temperature is regulated to precisely that relative temperature which had been present at the time at which the increase in temperature was stopped and is therefore the target temperature, or which then also has to be 100° C. As an alternative, the power density which had been used at this time can be maintained.

The situation of the "vigorous boiling" state of the water in the cooking vessel being reached can also be generally or specially signalled to the operator. Signalling operations similar to those explained above are suitable in principle.

In a further refinement of the invention, it can be provided that a reduction in the power density at the at least one induction heating coil for the cooking vessel after the "lightly boiling" state has been identified is used, a first temperature difference between the temperature at the time of identification of the "lightly boiling" state and a temperature is ascertained, which temperature has been present 3 seconds to 20 seconds after the start of the reduction in the power density, that is to say in particular during the hold option. After this time of 3 seconds to 20 seconds has elapsed, the power density at the at least one induction heating coil can increase again or be increased by the controller. In particular, the power density can be increased to the prespecified power density during the initial heating of the water in the cooking vessel. This increase can be an above-described power increase from lightly boiling to vigorous boiling.

Thereafter, the power density can be reduced again and a second difference between a temperature at the time of the renewed reduction in the power density and a temperature after a time of between 3 seconds and 20 seconds after the reduction in the power density can be ascertained. This second difference is then compared with the first difference. In the case that the second difference is lower than the first difference, it is assumed that the relative temperature of the cooking vessel at the time of the initial reduction in the power density does not yet correspond to the "vigorous boiling" state, but rather only to the "lightly boiling" state. If this "lightly boiling" state is desired, the temperature is therefore suitable. The temperature can then be regulated at this temperature. If the "vigorous boiling" state is desired, the power density should be increased again for the purpose of even more intense heating up.

In a further refinement of the invention, it can be provided that the controller switches off the at least one induction heating coil after a time of a maximum of 2 hours when the cooking vessel is heated with a power density for maintaining the "lightly boiling" state. The time can lie at a maximum of 1 hour, as an alternative also at 5 minutes to 30 minutes, so that this state does not last so long that it is obvious that there is a fault or that the operator is no longer monitoring or has an eye on the cooking process at all.

In a similar way to that mentioned above, it can be provided that, during the heating of the cooking vessel, the at least one induction heating coil is operated at a power density which is sufficient in order to maintain the "vigorous boiling" state. The induction heating coil can then be switched off after a time of at most 30 minutes. This time can also be only a maximum of 20 minutes. Finally, a considerably higher power density than described above is set and there is therefore a certain higher risk of a malfunction. As an alternative to switching off the induction heating coil, the power density can be reduced by at least 30% to 60%.

In a yet further refinement of the invention, it can be provided that the controller sets a medium or rather low power density for the at least one induction heating coil in order to maintain the "lightly boiling" state or the "vigorous boiling" state. Here, a power density of less than 4 W/cm$^2$, preferably of less than 3 W/cm$^2$, may be sufficient in order to maintain the "lightly boiling" state. It can be provided that an operator selects, on an operator control device of the induction hob, which operator control device is naturally connected to the controller, either a corresponding prespecified power density and then additionally a special function which results in the hold option being achieved. As an alternative, it is possible to equally and only start a specific programmed sequence in which the operator does not in any way directly pre-specify the power density as a cooking level, but rather only this manner of heating in which, in the "lightly boiling" state, the hold option is offered and, after this has elapsed without corresponding operation, is further heated up until vigorous boiling.

In a yet further refinement of the invention, it can be provided that the controller is designed to automatically offer the hold option, possibly after basic operator-dependent programming, when a cooking vessel which has been put into place is heated up and the temperature of virtually 100° C. or a temperature somewhat below the boiling point is reached. Therefore, the hold option is always available to an operator, without the operator having to preselect the hold option by way of a certain degree of setting effort. The abovementioned time delay of a maximum of 20 seconds for the hold option appears to be reasonable, even if an operator does not especially desire this hold option at all.

These and further features are described not only in the claims but also in the description and the drawings, it being possible for the individual features to each be implemented in their own right or in groups in the form of sub-combinations for an embodiment of the invention and in other fields, and to represent advantageous embodiments, worthy of protection in their own right, for which protection is claimed here. The subdivision of the application into individual sections and the intermediate headings do not restrict the generality of the statements made therein.

BRIEF DESCRIPTION OF THE SEVERAL VIEWS OF THE DRAWINGS

Exemplary embodiments of the invention are schematically illustrated in the drawings and will be explained in greater detail in the text which follows. In the drawings.

DETAILED DESCRIPTION

Figure 1:
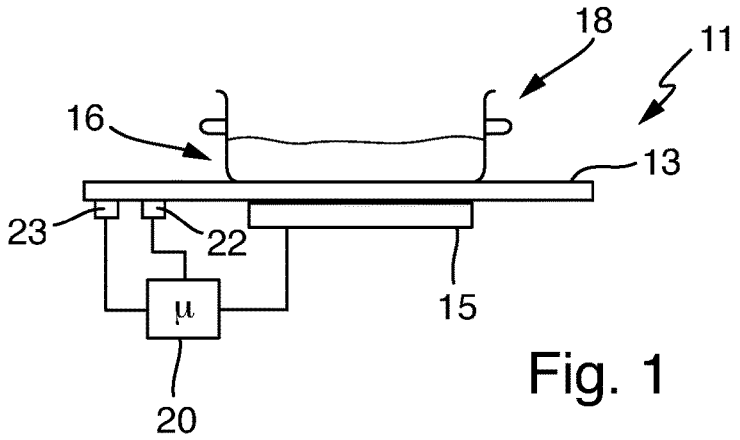
FIG. 1 shows a schematic illustration of an induction hob comprising an induction heating coil for carrying out the method according to the invention.

FIG. 1 shows, in a highly schematic manner, a portion of an induction hob 11 comprising a hob plate 13 and an induction heating coil 15 which is arranged beneath the hob plate, as are known from the prior art, in particular from the prior art cited above. A pot 18 containing water is set down on a cooking point 16 which is formed above the induction heating coil 15, in order to heat the water or bring the water to a boil.

Furthermore, the induction hob 11 has a controller 20 which is connected to the induction heating coil 15 in order to detect the operating parameters, described in the introductory part, of the induction heating coil 15, in particular an oscillation response, in order to in this way detect a relative temperature profile of the temperature of the base of the pot 18. Reference is made to documents US 2011/120989 A1 and US 2013/078346 A1, cited in the introductory part, in this respect. Furthermore, the controller 20 is also connected to a visual or acoustic display 22 and at least one operator control element 23. Furthermore, the controller 20 is advantageously connected to all of the operator control elements of the induction hob 11 and forms the only controller of the induction hob 11.

Figure 2:
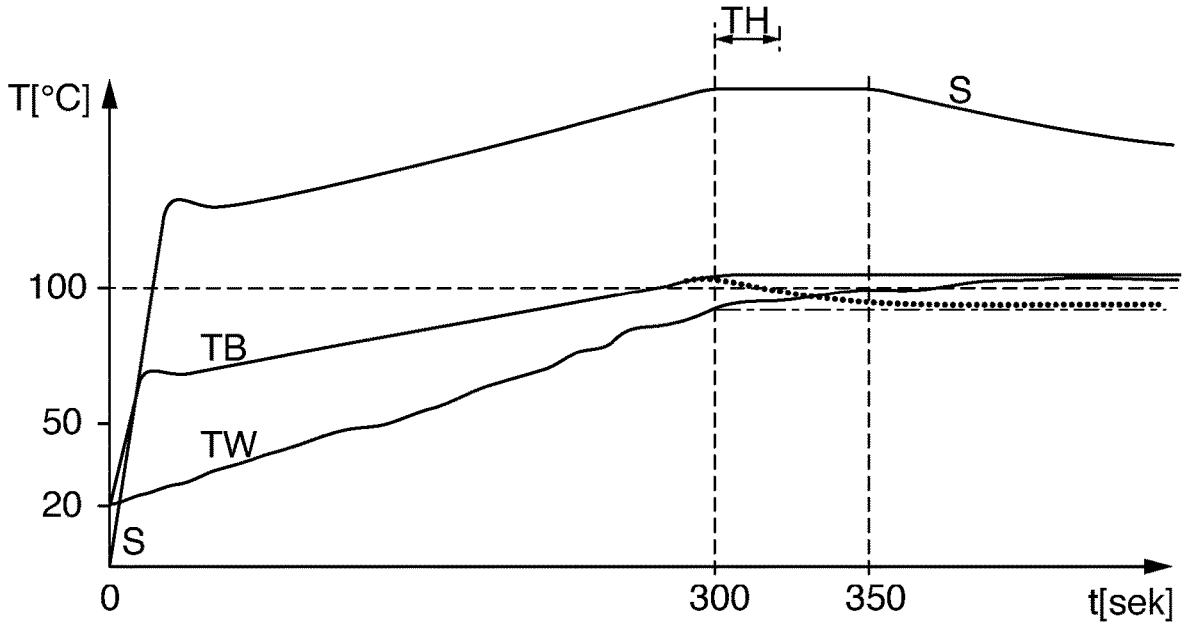
FIG. 2 shows different temperature profiles and also a profile of an operating parameter of an induction heating coil of the induction hob from FIG. 1 as a relative temperature profile with respect to time.

FIG. 2 is a graph showing, with respect to time t, the temperature $T_B$ of the base of the pot 18, specifically at the top side of the base, and also the temperature $T_W$ of the water in the pot 18. These values are not detected during the method according to the invention and are shown here by way of example in accordance with measurements which were carried out within the scope of the invention. The temperature $T_W$ of the water is an average temperature since the water is somewhat hotter directly above the pot base than in the upper region. An inhomogeneous temperature distribution of this kind is usual during the heating process. The temperatures differ from one another by a maximum of approximately 10° C. to 20° C. Furthermore, the relative temperature profile S of the base of the pot 18 with respect to time is shown, as can be detected from the above-described operating parameters of the induction heating coil 15.

At time t=0, a pot 18 containing water, which pot is set down on the induction hob 11 or the cooking point 16, is heated by the induction heating coil 15. To this end, a high power density, for example a maximum boost power density of 10 W/cm$^2$, is prespecified by the controller 20. During the initial approximately 20 seconds to 40 seconds, the relative temperature profile S increases sharply; the pot base temperature $T_B$ also increases, albeit less sharply. The temperature $T_W$ of the water however increases only slowly. In this phase, it is primarily the pot base that is heated up since only the pot base can couple the heat into the water, this naturally being slower.

Between a time of approximately 50 seconds to 250 seconds, the temperatures $T_B$ and $T_W$ run with a virtually constant gradient and also virtually in parallel; the water temperature $T_W$ approximates the temperature profile $T_B$ to a certain extent. At the time of approximately t=300 seconds, the average water temperature $T_W$ reaches a value of approximately 85° C. The pot base can have reached a temperature of 100° C. a few seconds beforehand, this meaning that this temperature, as shown, cannot be exceeded provided that there is still water in the pot 18. Here, the profile S levels off or its gradient becomes shallower; the profile S is approximately horizontal starting from t=300 seconds. The invention then takes effect, as has been described above. Before this is discussed in greater detail, a further continued cooking process should be described by way of example. Up until time t=370 seconds for example, the water temperature $T_W$ continues to increase, but less sharply at the end. At this time, the water is then also heated to approximately 100° C. throughout; that is to say all of the water in the pot 18 is boiling, as it were, in a bubbling manner as the "vigorous boiling" state.

At time t=300 seconds, the water in the pot 18 has reached the "lightly boiling" state. Even if an average water temperature $T_W$ is only approximately 85° C., steam bubbles are already clearly forming on and becoming detached from the pot base at the bottom, and therefore an operator can already identify a certain degree of boiling or light boiling. This is also sufficient for processes such as simmering pasta, potatoes or the like, but is not yet sufficient for starting to boil pasta in the usual manner, for example.

Therefore, it can be seen that, after the "light boiling" state is reached, when the pot base has already reliably reached a temperature of $T_B$=100° C., a further 60 seconds still pass until the water in the pot 18 is also actually boiling in a bubbling manner and therefore is at a temperature of $T_W$=100° C. throughout on average. Furthermore, the relative temperature profile S shows that there are changes in the profile S or the gradient at these two times, which changes can be evaluated by the controller 20.

In the method according to the invention, the controller 20 identifies the start of the "lightly boiling" state at time t=300 seconds from the relative temperature profile S, since here the relative temperature profile S also substantially levels off or even becomes horizontal; that is to say the gradient of the profile becomes zero. Therefore, this time can be approximately identified from the first derivative of the relative temperature profile S. Whereas the boiling process has also been started by the controller 20 at a high or maximum power density, the above-described hold option is offered for the hold time $T_H$, indicated at the top, of approximately 20 seconds after the "lightly boiling" state is identified at time t=300 seconds. The power density is greatly reduced to approximately 2 W/cm$^2$ to 3 W/cm$^2$; that is to say it amounts to only 20% to 25%. The controller 20 provides an operator with a corresponding signal on the display 22 and the above-described hold time $T_H$ is started. Owing to the reduced power density, the "lightly boiling" state is then maintained as far as possible and the water temperature $T_W$ assumes the profile illustrated by the dash-and-dot line, that is to say remains approximately at 85° C. This hold option which is offered to the operator can then be adopted by operating the operator control element 23 if this takes place within the hold time $T_H$. Operation of the operator control element 23 or adoption of the hold option then leads to this reduced power density being approximately maintained or to a temperature regulation means regulating the temperature at the temperature $T_W$ at time t=300 seconds by means of the relative temperature profile S. This is illustrated in FIG. 2 by the constant dash-and-dot profile of the water temperature $T_W$ at 85° C.

However, if the operator allows the hold time $T_H$ to pass and therefore does not use the hold option, the previous high power density, here even the maximum boost power density, can be set again after the hold time has elapsed. In this case, the temperature would again increase up to 100° C. in accordance with the profile, illustrated by the solid line, for the water temperature $T_W$ in FIG. 2. As an alternative, after the hold option or the hold time has passed without any result, the power density can be increased by the controller 20, but not to the initially used maximum boost power density, but rather to a high power density which lies at, for example, from 4 W/cm$^2$ to 6 W/cm$^2$. The water in the pot is then also heated to a final temperature of 100° C. throughout again, but this lasts somewhat longer.

The profile for the pot base temperature $T_B$ is illustrated using a dash-and-dot line starting from the time of 300 seconds when the power during the hold option has been reduced by the controller 20. Owing to this reduction in power, the pot base temperature $T_B$ also drops to a certain extent, as illustrated by the dotted line. In the case of the hold option being used, a low power density then remains, so that the pot base temperature $T_B$ has approximated the water temperature $T_W$ and is equal to the water temperature in the long term, here starting from approximately 370 seconds for example.

That which is claimed:

1. A method for operating an induction hob in order to heat water in a cooking vessel being placed above at least one induction heating coil of said induction hob, said method comprising:

driving, via a controller of said induction hob, said at least one induction heating coil to inductively heat said cooking vessel which has been put into place with a prespecified power density;

during said heating of said cooking vessel, operating parameters of said at least one induction heating coil are detected and evaluated by said controller in order to monitor a relative temperature profile of said temperature of a cooking vessel base of said cooking vessel;

identifying, via the controller, as soon as said relative temperature profile of said cooking vessel base levels off to a significant extent or a gradient of said relative temperature profile decreases, and determines this as a situation of a lightly boiling state and of a temperature of a top side of said cooking vessel base which is 5° C. to 15° C. below said boiling point being reached;

automatically reducing said prespecified power density to a reduced power density for a predetermined hold time;

offering an operator a hold option in such a way that, by operating an operator control element, said temperature is regulated at a value at a time of said start of said hold time by means of automatic setting of said reduced power density, or said prespecified power density at said time of said start of said lightly boiling state is kept constant; and after said hold time has elapsed without an operating process for said induction heating coil, increasing said prespecified power density to a higher power density and operating, via the controller, said at least one induction heating coil with the higher power density for further heating said cooking vessel of said water contained therein to a higher temperature.

2. The method according to claim 1, wherein said controller automatically reduces said power density to a value of between 1 W/cm$^2$ and 3.5 W/cm$^2$ or by 10% to 50% for said predetermined hold time.

3. The method according to claim 1, wherein said controller signals to said operator that said temperature of almost 100° C. or between 85° C. and 100° C. as a lightly boiling state of water in said cooking vessel has been reached.

4. The method according to claim 1, wherein said controller provides said operator with said hold option for said hold time being of a maximum of 20 seconds.

5. The method according to claim 1, wherein, to this end, at least said prespecified power density is maintained during said initial heating of said cooking vessel or a higher power density is set in order to heat said water in said cooking vessel to a greater extent to a higher temperature for a vigorous boiling state.

6. The method according to claim 5, wherein:

after said vigorous boiling state of said water in said cooking vessel has been identified by an increase in said relative temperature of said cooking vessel base being stopped, said operator is offered a boil option for a predetermined boil option time of a maximum of 20 seconds, in which boil option operation of an operator control element has an effect that said controller sets said power density at said at least one induction heating coils such that said vigorous boiling state is maintained at said at least one induction heating coil or in said hob.

7. The method according to claim 6, wherein:

said vigorous boiling state is maintained by regulation at precisely said relative temperature at said time of said increase in said temperature being stopped or by maintaining said power density set at said time.

8. The method according to claim 5, wherein said controller signals to said operator that said vigorous boiling state of said water in said cooking vessel has been reached.

9. The method according to claim 5, wherein:

said controller switches off said at least one induction heating coil after a time of a maximum of 30 minutes, in an instance in which said cooking vessel is heated with a power density for maintaining said vigorous boiling state.

10. The method according to claim 5, wherein:

said controller reduces said power density by at least 30% to 60% after a time of a maximum of 30 minutes, in an instance in which said cooking vessel is heated with a power density for maintaining said vigorous boiling state.

11. The method according to claim 5, wherein:

said controller sets a low power density for said at least one induction heating coil for operating said induction heating coil in order to maintain said lightly boiling state or to maintain said vigorous boiling state.

12. The method according to claim 11, wherein:

said controller sets a low power density for said at least one induction heating coil for operating said induction heating coil in order to maintain said lightly boiling state or to maintain said vigorous boiling state, which is a power density of less than 3 W/cm$^2$ for said lightly boiling state.

13. The method according to claim 1, wherein:

a reduction in said power density at said at least one induction heating coil after said lightly boiling state has been identified is used to ascertain a first temperature difference between said temperature at a time of identification of said lightly boiling state and a temperature 3 seconds to 10 seconds after said start of said reduction in said power density, wherein, after said time of 3 seconds to 10 seconds has elapsed, said controller increases said power density at said at least one induction heating coil again.

14. The method according to claim 13, wherein:

said power density is increased to said prespecified power density during said initial heating of said water in said cooking vessel;

said power density is then reduced again and a second difference between a temperature at a time of said renewed reduction in said power density and a temperature after a time of between 3 seconds and 10 seconds thereafter is ascertained;

said second difference is then compared with said first difference; and in a case that said second difference is lower than said first difference, said relative temperature of said cooking vessel at said time of said initial reduction in said power density is not yet classified as a vigorous boiling state, but rather as a lightly boiling state.

15. The method according to claim 14, wherein said increase is a power increase according to claim 1.

16. The method according to claim 1, wherein:

said controller switches off said at least one induction heating coil after a time of a maximum of 2 hours in an instance in which said cooking vessel is heated with a power density for maintaining said lightly boiling state.

17. An induction hob comprising:

at least one induction heating coil;

a controller; and an operator control element, wherein said controller is configured to:

drive said at least one induction heating coil to inductively heat water in a cooking vessel placed above said at least one induction heating coil of the induction hob, wherein the at least one induction heating coil has been put into place with a prespecified power density;

during said heating of said cooking vessel, detect and evaluate one or more operating parameters of said at least one induction heating coil in order to monitor a relative temperature profile of said temperature of a cooking vessel base of said cooking vessel;

identify, as soon as said relative temperature profile of said cooking vessel base levels off to a significant extent or a gradient of said relative temperature profile decreases, and determine this as a situation of a lightly boiling state and of a temperature of a top side of said cooking vessel base which is 5° C. to 15° C. below said boiling point being reached;

identify as soon as said relative temperature profile of said cooking vessel base levels off to a significant extent or a gradient of said relative temperature profile decreases, and determine this as a situation of a lightly boiling state and of a temperature of a top side of said cooking vessel base which is 5° C. to 15° C. below said boiling point being reached;

automatically reduce said prespecified power density to a reduced power density for a predetermined hold time;

offer an operator a hold option via the operator control element such that said temperature is regulated at a value at a time of said start of said hold time by means of automatic setting of said reduced power density, or said prespecified power density at said time of said start of said lightly boiling state is kept constant; and after said hold time has elapsed without an operating process for said induction heating coil, increase said prespecified power density to a higher power density and operate said at least one induction heating coil with the higher power density for further heating said cooking vessel of said water contained therein to a higher temperature.

18. A method for operating an induction hob in order to heat water in a cooking vessel being placed above at least one induction heating coil of said induction hob, said method comprising:

driving, via a controller of said induction hob, said at least one induction heating coil to inductively heat said cooking vessel which has been put into place with a prespecified power density;

during said heating of said cooking vessel, operating parameters of said at least one induction heating coil are detected and evaluated by said controller in order to monitor a relative temperature profile of said temperature of a cooking vessel base of said cooking vessel;

identifying, via the controller, as soon as said relative temperature profile of said cooking vessel base levels off to a significant extent or a gradient of said relative temperature profile decreases, and determines this as a situation of a lightly boiling state and of a temperature of a top side of said cooking vessel base which is 5° C. to 15° C. below said boiling point being reached;

automatically reducing said power density to a reduced power density for a predetermined hold time;

offering an operator a hold option in such a way that, by operating an operator control element, said temperature is regulated at a value at a time of said start of said hold time by means of automatic setting of said reduced power density, or said prespecified power density at said time of said start of said lightly boiling state is kept constant; and setting said prespecified power density again after said hold time has elapsed without an operating process for said induction heating coil, wherein:

a reduction in said power density at said at least one induction heating coil after said lightly boiling state has been identified is used to ascertain a first temperature difference between said temperature at a time of identification of said lightly boiling state and a temperature 3 seconds to 10 seconds after said start of said reduction in said power density, wherein, after said time of 3 seconds to 10 seconds has elapsed, said controller increases said power density at said at least one induction heating coil again;

said power density is increased to said prespecified power density during said initial heating of said water in said cooking vessel;

said power density is then reduced again and a second difference between a temperature at a time of said renewed reduction in said power density and a temperature after a time of between 3 seconds and 10 seconds thereafter is ascertained;

said second difference is then compared with said first difference; and in a case that said second difference is lower than said first difference, said relative temperature of said cooking vessel at said time of said initial reduction in said power density is not yet classified as a vigorous boiling state, but rather as a lightly boiling state.

* * * * *